US005520157A

United States Patent [19]

Pontoppidan

[11] Patent Number: 5,520,157

[45] Date of Patent: May 28, 1996

[54] DUAL-JET FUEL INJECTOR WITH PNEUMATIC ASSISTANCE IN SPRAY GENERATION FOR AN INTERNAL COMBUSTION ENGINE FED BY INJECTION

[75] Inventor: Michaël Pontoppidan, Rueil Malmaison, France

[73] Assignee: Magneti Marelli France, Nanterre Cedex, France

[21] Appl. No.: 499,545

[22] Filed: Jul. 7, 1995

[30] Foreign Application Priority Data

Jul. 12, 1994 [FR] France ..... 94 08646

[51] Int. Cl.[6] ..... F02M 23/00

[52] U.S. Cl. ..... 123/531; 123/585; 123/432; 239/533.12

[58] Field of Search ..... 123/432, 585, 123/586, 587, 531; 239/533.12

[56] References Cited

U.S. PATENT DOCUMENTS

| | | | |
|---|---|---|---|
| 4,519,370 | 5/1985 | Iwata | 123/432 |
| 4,955,347 | 9/1990 | Toyoda | 123/531 |
| 4,982,716 | 1/1991 | Takeda et al. | 123/531 |
| 5,027,778 | 7/1991 | Nogi et al. | 123/531 |
| 5,105,792 | 4/1992 | Ichikawa et al. | 123/531 |
| 5,150,691 | 9/1992 | Imajo | 123/432 |
| 5,203,308 | 4/1993 | Liskow | 123/531 |
| 5,220,900 | 6/1993 | Wakeman | 123/531 |
| 5,224,458 | 7/1993 | Okada et al. | 123/432 |
| 5,269,281 | 12/1993 | Hafner | 123/531 |
| 5,323,966 | 6/1994 | Buccholz | 239/533.12 |

FOREIGN PATENT DOCUMENTS 4103918 8/1991 Germany .

*Primary Examiner*—Erick R. Solis
*Attorney, Agent, or Firm*—Larson and Taylor

[57] ABSTRACT

The injector has two calibrated holes that deliver two jets of fuel into a zone into which there open out defined holes for passing air that are formed in a spray-generating adapter which is fed with air from a channel that is substantially at atmospheric pressure. The air-passing holes are distributed and oriented in such a manner that when steep pneumatic gradients are applied across the holes, at low or medium engine loads, one of the two sprayed fuel jets is deflected towards the other and mixes therewith to form a single jet confined in one only of the two intake manifold ducts, while at high engine loads both of them are fed. The injector is suitable for fitting to internal combustion engines fed by a multipoint injection installation and having two intake manifold ducts per combustion chamber.

7 Claims, 1 Drawing Sheet

DUAL-JET FUEL INJECTOR WITH PNEUMATIC ASSISTANCE IN SPRAY GENERATION FOR AN INTERNAL COMBUSTION ENGINE FED BY INJECTION

The invention relates to a "dual-jet" type fuel injector for feeding an internal combustion engine having at least two intake valves per combustion chamber of the engine by injecting fuel through two calibrated holes for delivering respective jets of fuel along mutually diverging axes towards the two valves.

The invention thus relates to the field of fuel injectors used in car engines fitted with a fuel injection installation that operates by "multipoint" type injection, i.e. that comprises, for each combustion chamber, at least one electrically controlled injector that opens out into the intake manifold in the vicinity of at least two intake valves per cylinder.

In such engines, in order to satisfy various requirements that are necessary for ensuring proper combustion behavior, and in particular for controlling the uniformity of the air-fuel mixture in the combustion chambers and for regulating the acoustic tuning of the engine while obtaining the looked-for torque performance, proposals have been made to feed each combustion chamber via a plurality of air intake ducts, and in the limit, via as many ducts as the combustion chamber has intake valves, so as to regulate the feed to each combustion chamber by controlling the opening and closing of one or more ducts terminating upstream from the intake valves of the chamber.

In general, matching engine fuel feed to the load demand on the engine requires fuel injection characteristics to be varied in accordance with needs that, in modern engines, are defined by an electronic computer that controls the engine as a function of its load.

In the particular case of engines having two intake valves per combustion chamber, and more generally in the case of engines in which each combustion chamber is fed via at least two air intake manifold ducts, it is known to place a fuel injector in each of the feed ducts of each chamber, e.g. in each of two ducts feeding respective ones of the two intake valves of the chamber, and causing a first injector that injects fuel into a first feed duct, e.g. feeding a first valve, to inject when the load demand on the engine is low, and then, when the load demand is high, in causing the second injector also to inject fuel, this time into the second duct (which may branch from the first duct) so as to deliver a quantity of fuel (e.g. to the second intake valve) that is additional to the quantity provided to the corresponding combustion chamber by its feed from the first intake valve.

Such a configuration suffers from the drawback of being expensive and bulky since it requires one injector to be used per manifold duct, i.e. two injectors per combustion chamber, together with one control stage per injector.

To remedy that drawback, another known configuration consists in using a dual-jet injector for each combustion chamber having two intake valves, the dual-jet injector operating at low engine load as a single-jet injector by injecting a jet into a first air intake manifold duct leading to the first intake valve, and then at high engine load operating as a dual-jet injector, i.e. delivering, in addition to the first jet, a second jet of fuel that is injected into the second air intake manifold duct leading to the second intake valve.

By means of such a dual-jet injector, the conditions under which the fuel mixture is formed in the corresponding combustion chamber are better controlled by additionally closing to a greater or lesser extent one of the manifold ducts of each combustion chamber by a secondary throttle valve downstream from the main throttle valve that regulates air feed to the intake manifold, while ensuring that a good air-fuel mixture is prepared.

To this end, proposals have already been made for a dual-jet type injector whose injector nose has two calibrated outlet holes for respective fuel jets having mutually divergent axes oriented towards the two corresponding manifold ducts, with the injector body containing a first electromagnet that has a first control winding which is subjected to on/off electrical control to displace a core that moves together with a shutter in translation relative to a first calibrated hole so as to deliver a first jet when the shutter is moved away from the first calibrated hole by the core being displaced into contact with an abutment against a first return spring, the injector also including a second electromagnet in alignment with the first, having a second control winding that is likewise subjected to on/off electrical control to act against a second return spring to displace the abutment, thereby causing the sliding core which is constrained to move in translation with the shutter to move the shutter away from the second calibrated hole so as to deliver a second jet via the second calibrated hole. Thus, by powering the winding of the second electromagnet it is possible to move the abutment that limits the stroke of the core and simultaneously release the second calibrated hole to deliver the second jet in addition to the first. When no electricity is fed to the windings, the shutter together with the core is returned to the position for closing both calibrated holes by the return springs.

That known injector does indeed provide the above-mentioned advantages, but it also suffers from the drawback of having moving equipment with a considerable stroke, since the core co-operates with the rectilinearly displaceable abutment device to define one or two, as the case may be, variable air gaps which are in series, thereby giving rise to poor electromagnetic efficiency.

Another drawback of that injector is that it does not prepare air-fuel mixing as well as injectors of another known type in which spray generation is pneumatically assisted with air at a limited flow rate.

In injectors in which spray generation is assisted by air, as in U.S. Pat. No. 4,519,370, an adapter mounted on the injector nose defines a feed channel for air to assist in spray generation, which channel is installed directly in parallel with the air intake circuit for idling and for low to medium load operation of the engine, air being taken upstream from the throttle valve that regulates air intake into the manifold such that the channel is fed with air that is substantially at atmospheric pressure. The adapter has a plurality of defined holes for passing air that are distributed symmetrically around the axis of the injector nose so that the streams of air passing through these holes ensure that the jets of fuel squirting from the calibrated fuel outlet holes formed in the injector nose are broken up into spray outside the injector nose.

The fuel jets are thus broken up into spray by the symmetrical diffusion of jets of air for pneumatically assisting spray generation in the jets of fuel.

A dual-jet injector with pneumatic assistance is also known from DE-A-4 129 834 which injects fuel through two calibrated outlet holes for fuel jets having diverging axes, the holes being formed in a nose of an injector body that includes a shutter constrained to move in translation with an electromagnet core that is urged towards a position in which it closes the calibrated holes by resilient return means against which the shutter is moved away from the calibrated holes by feeding electricity to a control winding of the electromagnet, thereby delivering at least two jets of fuel, the two calibrated holes opening out into a zone for spray generation with pneumatic assistance, that is defined in part by a pneumatic spray-generation adapter that forms, substantially around the nose of the injector, a channel that is fed with air substantially at atmospheric pressure for assisting in spray generation, the adapter presenting a plurality of defined holes for passing air from the channel into the spray-generation zone and having axes extending substantially transversely to the fuel jets so as to provide pneumatic assistance in breaking up said jets into spray.

According to DE-A-4 129 834, by using different shapes and sections for a plurality of air holes, it is possible to achieve asymmetrical distributions of the jets of air which encounter the lets of fuel and atomize them, thereby also obtaining different fuel jets. In addition, an asymmetrical distribution of the air holes, in particular of the air holes offset from upstream to downstream provides better atomization of the fuel which is obtained by pre-atomization by means of an upstream air hole and by post-atomization by means of a downstream air hole. At all operating speeds, that injector delivers two diverging jets of fuel with greater or lesser pneumatic assistance in spray generation.

However, those known injectors with pneumatic assistance in spray generation are not adapted to injecting fuel selectively into one or both of two air intake manifold ducts feeding each combustion chamber in engines of the type under consideration, and in particular engines having two intake valves per combustion chamber.

The problem on which the invention is based is to remedy the above drawbacks of air-assisted injectors of known type as described above, and the object of the invention is to provide a dual-jet type injector having a magnetic circuit that is more efficient, of structure that is more compact, in which spray generation is ensured by a mechanical device with pneumatic assistance for preparing the air-fuel mixture, and in which the flow rate of assistance air is limited.

In general, the object of the invention is to provide a dual-jet type injector with pneumatic assistance in spray generation, having a limited flow rate of assistance air flow rate, and more suitable than known injectors for satisfying various practical requirements.

To this end, the invention provides a dual-jet type injector of the kind known from DE-A-4 129 834, and which is characterized in that the defined holes for passing air are distributed in the adapter in such a manner that when the winding of the electromagnet is powered, and while the engine is used under heavy load, causing a low pressure gradient between the channel for feeding assistance air at limited flow rate and the spray-generation zone forming a portion of two air intake manifold ducts for the corresponding combustion chamber, two jets of fuel passing through the calibrated holes cross the spray-generation zone towards the ducts, whereas while the engine is idling and while it is under low to medium load, causing the pressure gradient to be high, one of the jets of sprayed fuel is deflected by the jets of air penetrating through the defined holes into the spray-generation zone towards the other fuel jet with which it mixes to form a single jet of fuel spray, confined within only one of the manifold ducts, so that the fuel is injected selectively into one or both of the two manifold ducts.

The injector of the invention with limited air flow rate for pneumatic assistance in spray generation modulates the rate at which fuel is injected into each of two corresponding air intake manifold ducts by varying the orientation of one of the jets of sprayed fuel as a function of engine load, and thus as a function of intake air pressure gradient. If the load is small or medium, or if the engine is idling, for example, then the intake air regulating throttle valve is ajar so there is a large pressure gradient between the assistance air feed channel which is substantially at atmospheric pressure and the manifold ducts which are at lower pressure since they are connected to the engine intake, so the two sprayed fuel jets are united as a single jet in the spray-generation zone by means of the shape, section, distribution, and number of air-passing holes, and the single jet is delivered to one of the two corresponding manifold ducts. In contrast, if the engine load is high, and thus the air intake throttle valve is wide open, then the pressure gradient across the defined air-passing holes in the adapter is small so the two jets retain their diverging orientations imparted by the axes of the calibrated fuel outlet holes, and each of them is directed to a respective one of the two corresponding manifold ducts.

When the axes of the two calibrated outlet holes in the nose of the injector are contained substantially in the same midplane that also contains the axis of the injector which is generally cylindrical in shape, as is the case for most "dual-jet" injectors, it is advantageous for the defined air-passing holes of the adapter of the injector of the invention to be distributed substantially symmetrically about the midplane containing the axes of the calibrated holes, but asymmetrically about the plane perpendicular thereto and containing the axis of the injector.

Under such circumstances, accurate deflection of one of the sprayed fuel jets towards the other is reliably and repeatably ensured if the distribution of defined air-passing holes in the adapter is advantageously such as to comprise a first hole having its axis extending substantially in the midplane containing the axes of the calibrated fuel passing holes, and at least two defined holes on either side of said midplane having their axes inclined relative to said midplane and converging towards the inside of the spray generating zone.

In order to obtain an injector which is compact, and in particular of limited axial size, and also to obtain a limited axial air gap, it is advantageous for the two calibrated outlet holes of the nose to be formed in the same plane calibration pellet that simultaneously constitutes a seat for the shutter and a diaphragm for hydraulically generating a spray of fuel, the pellet being substantially perpendicular to the axis of the injector and co-operating with a plane shutter whose face that faces the pellet has two sealing ribs which are applied against the pellet and around the calibrated holes in the hole closure position.

In an advantageous and simple embodiment of the injector, the pellet is held against a rim of the body with an interposed sealing ring by means of a spacer inside the body and matched to the core for adjusting the axial air gap between the core and a yoke of the electromagnet.

For the same reasons, the shutter is advantageously integral with one end of the core which is tubular and houses at least a portion of a helical compression spring that constitutes resilient return means urging the shutter towards the calibrated hole closure position. In which case, it is advantageous for the helical spring to bear against the plane shutter that directly constitutes the end of the tubular core, in order to urge it against the pellet.

BRIEF DESCRIPTION OF THE DRAWINGS

Other advantages and characteristics of the invention can be seen from the non-limiting description given below of an embodiment described with reference to the accompanying drawing, in which.

Figure 1:
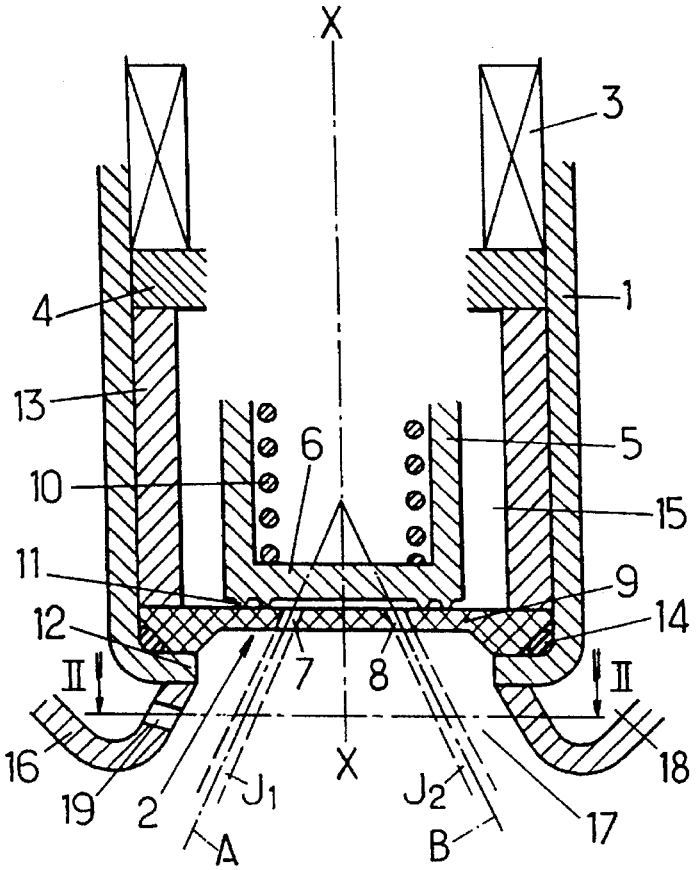
FIG. 1 is a fragmentary axial section through a dual-jet injector having spraying assisted by limited flow rate air.

The dual-jet injector shown in part in the figures comprises an essentially cylindrical body 1 of circular section about an axis X—X and an injector nose 2 in the form of a cylindrical endpiece that is coaxial with the body 1 about its longitudinal axis X—X. The nose 2 is at the end of the injector that looks into the two ducts of the intake manifold into which air is to be fed with fuel. The body 1 surrounds an electromagnet having a single control winding 3 which is cylindrical, tubular, and disposed about the axis X—X, and which also has a stationary internal yoke that is shown in part at 4. The electromagnet also comprises a coaxial core 5 that is tubular and closed at its end remote from the winding 3 and the yoke 4 by a flat bottom 6 extending perpendicularly to the axis X—X and constituting a shutter that is integral with the core 5 for the purpose of closing two calibrated holes 7 and 8 formed in a seat 9. Inside the tubular core 5 there is received a helical compression spring 10 which has one end (not shown) bearing against the yoke 4 and its other end bearing against the inside face of the plane shutter 6 to urge it and the core 5 into a position for closing the calibrated holes 7 and 8 by means of two annular sealing ribs 11 which are coaxial and project from the face of the plane shutter 6 that faces the seat 9, and which are pressed against the inside face thereof around the calibrated holes 7 and 8 by the return spring 10 when in position to seal off the holes, as shown in FIG. 1.

The central portion of the seat 9 is constituted by a plane calibration pellet extending perpendicularly to the axis X—X of the injector, being mounted by its thicker peripheral portion being clamped between the rim 12 of the body 1 as formed by radially inward deformation of the corresponding end of the body 1, and a spacer 13 whose other axial end bears against the yoke 4 and which is matched to the core 5 so as to adjust the small and variable axial air gap defined between the yoke 4 and the end of the core 5 remote from the seat 9. A sealing O-ring 14 is mounted between the periphery of the pellet 9 on one side, and the body 1 and its radial rim 12 on the other side.

The calibrated holes 7 and 8 of the calibration pellet 9 are formed by cylindrical machining to be circular in section about respective axes A and B, the calibrated holes 7 and 8 being symmetrical about the axis X—X of the injector, and being such that their axes A and B lie in the same mid- or diametral plane that also contains the axis X—X. In addition, the axes A and B are inclined relative to each other and relative to the axis X—X so that they diverge or flare away from each other from their point of intersection on the axis X—X which is inside the core 5 towards the outside of the injector, as shown in FIG. 1.

As a result, when the winding 3 of the injector is fed with electricity, the core 5 and the plane shutter 6 are displaced against the return spring 10, thereby moving the shutter 6 away from the calibrated holes 7 and 8. Since the injector 1 is fed in conventional manner with fuel under pressure from a distribution pipe, the fuel arrives via the annular passage 15 between the spacer 13 and the core 5 and thus reaches the calibrated holes 7 and 8 through which two jets of fuel J1 and J2 squirt out, each being directed towards one of the two ducts of the feed manifold for a combustion chamber in the engine, and which jets, in the absence of any pneumatic spray-generating conditions would be thin jets of fuel each having little divergence and substantially centered on the midplane containing the axes X—X, A, and B. The calibration pellet 9 which constitutes a seat that co-operates with the shutter 6 and with its sealing ribs 11 also constitutes a diaphragm for hydraulically breaking up the fuel into spray along the two jets J1 and J2.

However, in addition, as for a known type of spray injector assisted by air at limited flow rate, the injector is fitted with an air spray adapter 16 that is generally annular in shape and which is mounted around the nose of the injector 2, co-operating therewith to define a zone 17 in which mixing and pneumatic assistance in spray generation take place, which zone forms a portion of the two manifold ducts that are to be fed. The two calibrated outlet holes 7 and 8 for the jets of fuel J1 and J2 thus open out into the zone 17 through which the jets J1 and J2 pass in order to penetrate into the manifold ducts proper.

The limited flow rate pneumatic spray-generating adapter 16 defines a peripheral channel 18 which is fed with air substantially at atmospheric pressure by a pipe connecting it to an air intake situated between the outlet of the engine air filter and the throttle valve used to regulate the main air feed of the engine. The air for pneumatically assisting spray generation and penetrating into the channel 18 of the adapter 16 is inserted into the spray generation and mixing zone 17 in the form of jets of air so as to ensure proper preparation of the air-fuel mixture in the jets J1 and J2 by passing through defined air-passing holes 19 formed with appropriate dimensions in the adapter 16 and provided in a special distribution and orientation, as shown in FIGS. 1 and 2.

Figure 2:
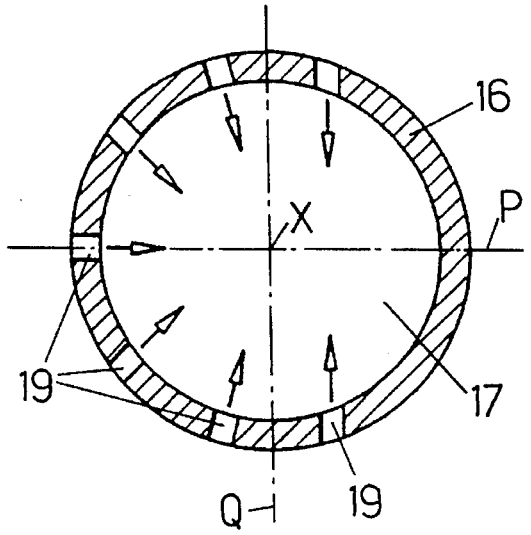
FIG. 2 is a diagrammatic section through the spray adapter of the FIG. 1 injector, on II—II of FIG. 1.

FIG. 2 shows that the defined air passage holes 19 of the adapter 16 are disposed symmetrically about the diametral and midplane P containing the axes A and B and the calibrated holes 7 and 8, and also containing the axis X—X of the injector, and simultaneously that these holes 9 are asymmetrical about the plane Q which is perpendicular to the plane P and which includes the axis X—X of the injector. In the example shown, one of the seven defined holes 19 also has its axis contained in the plane P, while the axes of the other holes 19 which are symmetrical in pairs about the plane P are inclined relative to said plane and converge towards each other and towards the plane inside the spray-generation zone 17. In FIGS. 1 and 2, the directions of the jets of air passing through the holes 19 are shown by arrows. FIG. 1 shows that the axis of each hole 19 is also slightly inclined in the upstream to downstream direction relative to the longitudinal axis X—X of the injector, and that the jets of air extend substantially transversely to the jets of fuel J1 and J2.

When the engine is under heavy load, i.e. when the air intake throttle valve is fully open, the special orientation and distribution of the defined air-passing holes 19 have the effect that the pressure gradient applied across the defined holes 19 between the channel 18 that is substantially at atmospheric pressure and the zone 17 that forms a portion of the intake manifold is a shallow gradient, and as a result the jets of air passing through the defined holes 19 neither disturb nor modify the orientation of the jets J1 and J2. The two corresponding ducts of the intake manifold are therefore fed simultaneously, each by a respective one of the jets.

In contrast, when the engine is operating at light or medium load or is idling, with the intake throttle valve ajar, the suction in the engine intake is considerable so the gradient applied to the defined air-passing holes 19 is large. The jets of air passing through the defined holes 19 are then sufficiently powerful, given the shape, section, number, disposition, and orientation of the holes 19, to deflect fuel jet J1 whose breakup into a spray is improved by the jets of air, towards the jet J2 so as to mix the jets and combine them into a single jet of fuel that is well broken up into a spray by pneumatic assistance and which is directed towards the single one of the two manifold ducts that is to be fed in this mode of operation. In this configuration, the dual-jet injector operates as a single jet injector. This deflection of one of the two spray jets of fuel towards the other is a result of the asymmetrical structure given to the means that cause the air for pneumatically assisting breaking into a spray to diffuse through the adapter 16. Changeover between the two operating configurations, dual-jet and single-jet, takes place automatically at a threshold pneumatic gradient for which the number, size, distribution, and orientation of the defined air-passing holes 19 were designed.

Thus, the air penetrating into the zone 17 is effective in improving breakup of the fuel into spray at low or medium loads, at all speeds, including idling, and also when the engine is under heavy load, again at all speeds. In particular, excellent spray generation is ensured when operating in low load modes such as when starting or while decelerating from high speed.

Although the injector as shown in FIGS. 1 and 2 is restricted to the elements required for understanding the invention, such an injector includes other conventional means: for example its body 1 is provided with means for being fixed in sealed manner in a housing of the manifold so that it opens out into the corresponding manifold ducts. Similarly, the inlet or rear body of the injector which is connected to the fuel feed pipe has not been shown. Also, as for known limited air flow rate injectors, the flow rate of air for assisting in spray generation in the injector of the invention may be about 0.5 kg/h to 0.9 kg/h.

A dual-jet injector is thus obtained which adapts naturally to single-jet operation on passing through a pneumatic gradient threshold, which corresponds to an engine load threshold, and which is simple and compact in structure, having a single control winding, an axial air gap that can be small so as to guarantee high efficiency of the electromagnetic circuit, and which provides excellent spray generation in the jet or jets as delivered.

I claim:

1. A dual-jet type fuel injector for feeding an internal combustion engine having at least two intake valves per combustion chamber of the engine, feed being by injecting fuel through two calibrated holes of the injector for delivering respective fuel jets along mutually diverging axes towards the two valves, the holes being formed in a nose designed to face towards the two valves, the nose belonging to a body of the injector that also has a shutter which is constrained to move in translation with an electromagnet core and which is urged towards a position for closing the calibrated holes by resilient return means against which the shutter is moved away from the calibrated holes by feeding electricity to a control winding of the electromagnet so as to deliver at least two jets of fuel, the two calibrated holes opening out into a zone for spray generation with pneumatic assistance, which zone is defined in part by a pneumatic spray-generation adapter forming a channel substantially around the nose of the injector and fed with air substantially at atmospheric pressure for assisting in spray generation and in other part by a portion of two intake manifold ducts, the adapter having a plurality of defined holes for passing air from the channel towards the zone and said defined holes having axes that extend substantially transversely to the fuel jets so as to assist pneumatically in breaking up said jets into spray, wherein the defined holes for passing air are distributed in the adapter in such a manner that when the winding of the electromagnet is powered, and while the engine is under heavy load, causing a low pressure gradient between the channel and the spray generation zone, thereby feeding assistance air at a limited flow rate such that two jets of fuel passing through the calibrated holes cross the spray-generation zone towards the two intake manifold ducts, whereas while the engine is idling and while it is under low to medium load, causing the pressure gradient to be high, one of the jets of sprayed fuel is deflected by the jets of air penetrating through the defined holes into the spray-generation zone towards the other fuel jet with which it mixes to form a single jet of fuel spray, confined within only one of the manifold ducts, so that the fuel is injected selectively into one or both of the two manifold ducts.

2. An injector according to claim 1, in which the axes of the two calibrated outlet holes from the nose are contained substantially in the same midplane also containing the axis of the generally cylindrical injector, wherein the defined air-passing holes of the adapter are disposed substantially symmetrically about said midplane, but asymmetrically about the plane perpendicular thereto and containing the axis of the injector.

3. An injector according to claim 2, wherein the defined air-passing holes of the adapter comprise a first defined hole whose axis lies substantially in the midplane containing the axes of the calibrated fuel-passing holes, and at least two defined holes on either side of said midplane, the axes thereof being inclined relative to the midplane and converging towards the inside of the spray-generating zone.

4. An injector according to claim 1, wherein the two calibrated outlet holes of the nose are formed in a calibration pellet that is substantially perpendicular to the axis of the injector and that co-operates with the shutter whose face facing the pellet has two sealing ribs pressed against the pellet and around the calibrated holes in the closed position thereof.

5. An injector according to claim 4, wherein the pellet is held against a rim of the body with a sealing ring being interposed between them, the pellet being held by a spacer inside the body and paired with the core to adjust an axial air gap between the core and a yoke of the electromagnet.

6. An injector according to claim 5, wherein the shutter is integral with one end of the core which is tubular and houses at least a part of a helical compression spring constituting the resilient return means for returning the shutter to its position in which it closes the calibrated holes.

7. An injector according to claim 6, wherein the helical spring bears against the shutter constituting the end of the tubular core to urge it towards the pellet.

* * * * *